United States Patent [19]

Ramsay

[11] 4,217,714

[45] Aug. 19, 1980

[54] DISPLAY SIGN

[75] Inventor: Charles F. Ramsay, Knoxville, Tenn.

[73] Assignee: A & E Plastik Pak Co., Inc., Industry, Calif.

[21] Appl. No.: 44,712

[22] Filed: Jun. 1, 1979

Related U.S. Application Data

[63] Continuation of Ser. No. 824,518, Aug. 15, 1977, abandoned.

[51] Int. Cl.[2] ..... G09F 13/04

[52] U.S. Cl. ..... 40/549; 40/574; 40/578

[58] Field of Search ..... 40/549, 574, 578, 572; 52/208

[56] References Cited

U.S. PATENT DOCUMENTS

| | | | |
|---|---|---|---|
| 2,427,557 | 9/1947 | Gregorius | 52/208 |
| 2,620,580 | 12/1952 | Dwinell | 40/549 X |
| 2,626,473 | 1/1953 | Howenstine | 40/574 |
| 2,833,069 | 5/1958 | Cairns | 40/574 |
| 3,023,524 | 3/1962 | Muse | 40/574 |
| 3,593,448 | 7/1971 | Schoepf et al. | 40/578 X |

FOREIGN PATENT DOCUMENTS

| | | | |
|---|---|---|---|
| 2217960 | 10/1973 | Fed. Rep. of Germany | 40/574 |

*Primary Examiner*—John F. Pitrelli

*Attorney, Agent, or Firm*—Ellsworth R. Roston

[57] ABSTRACT

A display sign including a frame member extending around the perimeter of the sign and with the sides of the frame member parallel to a common axis, at least one face member having a copy area located in a plane substantially perpendicular to the common axis, the face member including flange portions angularly disposed to the copy area and with the flange portions extending in a direction toward one edge of the frame member, and a retainer member extending along the one edge of the frame member and including an opening for receiving the flange portions and with the opening substantially aligned with the sides of the frame member and the flange portions of the one face member for providing the copy area of the one face member substantially coextensive with the sides of the frame member.

14 Claims, 4 Drawing Figures

DISPLAY SIGN

This is a continuation of application Ser. No. 824,518, filed Aug. 15, 1977, now abandoned.

The present invention relates to a display sign and more specifically a display sign of the type having two opposing plastic faces held by a metal frame to form an enclosed area between the two faces. The plastic faces form a copy area which may include written and visual material. This written and visual material may be illustrated through the use of illuminating means located within the enclosed area formed by the plastic faces and the frame.

The prior art sign constructions normally require a metal band or frame around the perimeter of the face so as to retain the plastic faces. This band intrudes into the copy area of the plastic face in an amount depending on the size of the sign. As an example, the metal band may be one and a half to two inches wide and extend around the perimeter of the sign. This type of structure is essentially similar to a normal window where a frame supports the glass and wherein the frame is visible.

The display sign of the present invention does not require this exposed metal band or frame and, therefore, presents a cleaner design to the viewer. In addition, the elimination of the exposed metal band or frame increases the copy area of the plastic face without increasing the size of the sign.

The display sign of the present invention includes a frame member and with the frame member located along an axis substantially perpendicular to the faces of the sign. A pair of retainer members are mounted along the edges of the frame member and extending outward along the axis of the frame member and with the retainers including a recessed portion to receive a flange portion of the plastic face. Specifically, the plastic face includes a circumferential flange which flange portion is at an angular relationship to the copy area of the plastic face. This flange portion may be at an angle slightly different than 9020 (for ease of manufacture) and with the retainers including the recessed portions to receive the ends of the flange portions. In this way, the copy area of the plastic face extends almost to the complete outer dimensions of the sign and with the flange portions of the faces retained in the recesses in the retainers. As indicated above, this specific structure provides for a cleaner design and increases the copy area without increasing the size of the sign.

A clearer understanding of the invention will be had with reference to the following description and drawings wherein FIG. 1 illustrates a front view of a display sign constructed in accordance with the teachings of the present invention;

Figure 1:
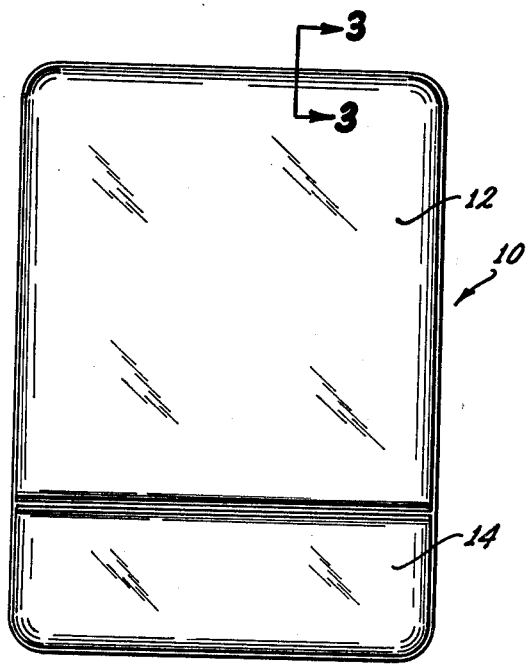

Turning specifically to FIG. 1, a front view of a display sign is illustrated as having a first display face 10 subdivided into two copy portions 12 and 14. The display face 10 and specifically the copy portions 12 and 14 form the total copy area of the display face for displaying the particular advertising copy.

Figure 2:
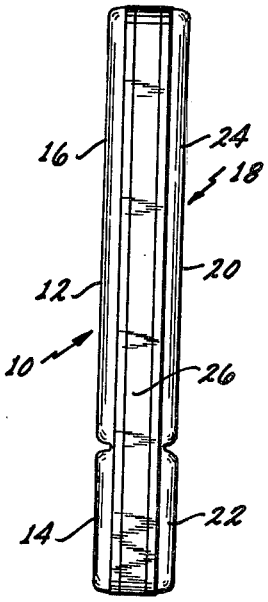
FIG. 2 illustrates a side view of the sign of FIG. 1.

As shown in FIG. 2, an edge portion of the display face 10 is folded over to form an integral flange 16 which flange extends completely around the perimeter of the display face 10. The display sign of the present invention also includes a second display face 18 which is similarly constructed as the face 10. The display face 18 includes two copy portions 20 and 22 and an integral flange 24 which extends completely around the perimeter of the display face 18. It is to be appreciated that the display faces 10 and 18 need not be separated into copy portions but may have a unitary copy area for each face.

Both face members 10 and 18 are retained in position by a frame member 26 which receives the flange portions 16 and 24 in retainer members 28 and 46. This may be more clearly seen in FIG. 3 where the faces 10 and 18 are shown to be held in a spaced relationship by the frame member 26 and with the flange portions 16 and 18 retained in retainer members 28 and 46 at the outside edges of the frame 26.

Since the faces 10 and 18 are maintained in a spaced relationship, illuminating means may be contained within the enclosed area formed by the combination of the faces 10 and 18 as separated by the frame member 26 so as to provide for an illuminated display sign. It is desirable to maintain the interior of the display sign in a sealed relationship to the exterior so that the interior of the display sign will be sealed from exterior weather conditions.

Figure 3:
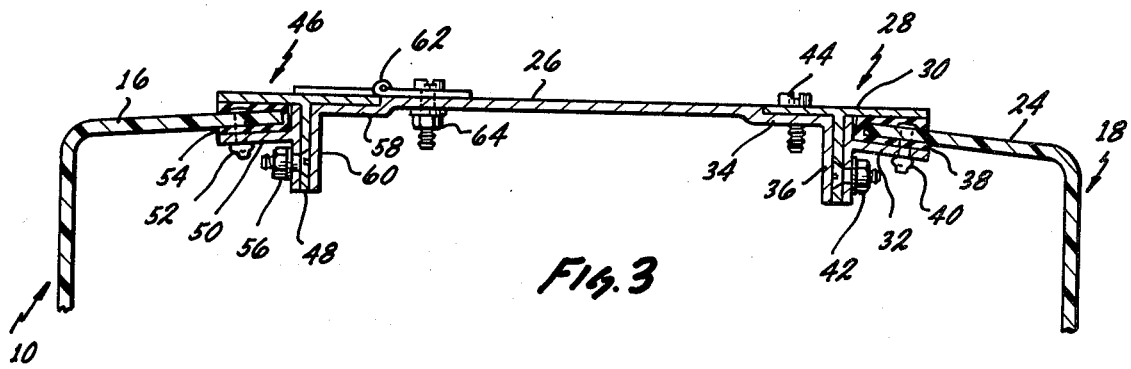
FIG. 3 illustrates a cross-sectional view taken along lines 3—3 of FIG. 1 showing the detailed construction of a first embodiment of the invention showing the retainers for attachment of the plastic faces to the frame member.

As shown in FIG. 3, the flange portion 24 is held within the retainer member 28 which member 28 is fixed at the end of the frame member 26. Specifically, the retainer member 28 is formed by two interlocking T-shaped members 30 and 32. The frame member 26 includes an end portion 34 and a folded flange 36 which portions are constructed to receive the retainer member 28.

The flange portion 24 of the display face 18 is positioned against one leg of the T-shaped member 32 and is sealed by a U-shaped gasket member 38. The flange portion 24 is retained in position against the T-shaped member 32 by a plurality of spaced rivets 40. The T-shaped member 32 is then locked within the T-shaped member 30 using a plurality of spaced nut-and-bolt combinations 42. It can be seen, therefore, that the flange portion 24 is sealed within the retainer 28 and specifically between the T-shaped members by the gasket 38. The retainer 28 is positioned at the edge of the frame 26 and is located within the portion 34 and abutting the flange 36 and with the retainer 28 maintained in position by a plurality of screw members 44.

The substantially identical retainer 46 is used to retain the flange portion 16 of the face member 10 in position. The retainer 46 includes a pair of T-shaped members 48 and 50 and with the flange portion 16 of the face 10 received against one leg of the T-shaped member 50 and held in position by a plurality of spaced rivets 52. An intermediate gasket 54 provides for the sealing of the retainer against the T-shaped member 50. The T-shaped member 50 is retained against T-shaped member 48 with the use of a plurality of nuts and bolts combination 56.

The retainer 46 is located at an edge portion 58 of the frame 26 and additionally including a right-angled flange portion 60. The retainer 46 is received against the flange portion 60 and within the edge portion 58. In order to allow the face 10 to be swung outward so as to allow access to the interior of the display sign, a continuous hinge 62 is positioned along one side of the frame 26. The hinge 62 has one leaf attached to the retainer 46 such as by welding to the T-shaped member 48 and with the other leaf attached to the frame 26 such as through the use of a plurality of nut-and-bolt combinations 64. The hinge 62 may be located along any one of the sides of the display sign so as to allow the face to be swung outwardly. In the specific example show, the hinge is along the top of the frame 26. The other three sides would have the retainer held to the frame 26 through the use of screws and would be similar to the screws 44 shown in FIG. 3.

Figure 4:
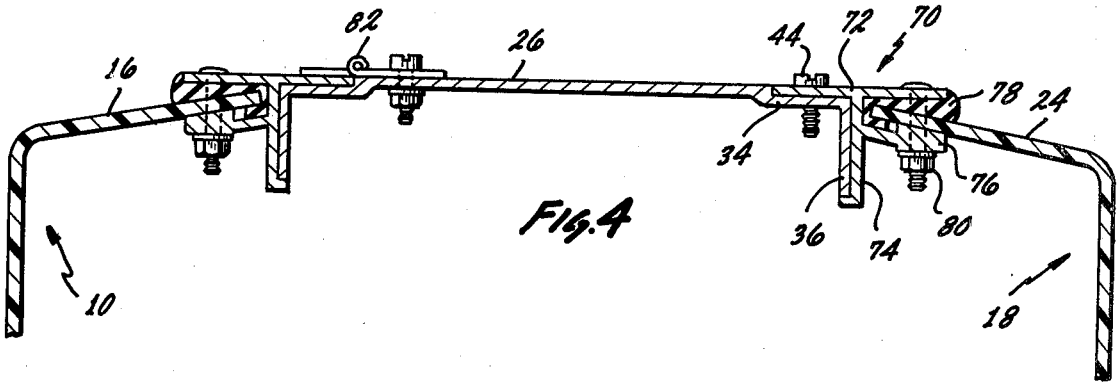
FIG. 4 illustrates a second embodiment of the invention showing an alternative structure for the retainers for attachment of the plastic faces to the frame member.

FIG. 4 illustrates a second embodiment of a display sign using an alternative design for the retainer members. Specifically as shown in FIG. 4, retainers 70 are each formed as one integral member having a first section 72, a second section 74 at right angles to the first section 72, and a third section 76 extending from the second section 74. The flange portion 24 of the face 18 is located between the sections 72 and 76 and with a gasket 78 sealing the end of the flange portion 24 within the opening formed between the sections 72 and 76. A plurality of spaced nut and bolt combinations 80 retain the end of the flange portion 24 within the opening formed in the retainer 70. As with the embodiment of FIG. 3, one edge portion of one side of the sign may have its retainer member 70 include a hinge such as hinge 82 shown in FIG. 4.

As can be seen in view of the above description and drawings, the display sign of the present invention provides for the copy area for the sign to be substantially co-extensive with the outer dimensions of the sign. This presents a cleaner design to the viewer and increases the copy area of the faces of the display sign without increasing the size of the sign. Although the flange portions of the faces are shown to diverge at an angle slightly different than 90°, generally for ease of fabrication, it is to be appreciated that this angular variation still allows for the copy area to be larger and to present a cleaner appearance than the prior art.

It is also to be appreciated that although the invention has been described with particular embodiments, various adaptations and modifications may be made and the invention is only to be limited by the appended claims.

I claim:

1. A display sign, including:

a frame member extending around the perimeter of the sign and having sides substantially parallel to a common axis, at least one face member having a copy area located in a plane substantially perpendicular to the common axis, the face member including substantially straightsided flange portions provided at its ends with a particular thickness and angularly disposed to the copy area in a direction substantially parallel to the frame member and displaced from the frame member, and a retainer member disposed in substantially flush relationship with the frame member and coupling the frame member and the flange portions of the face member and including an opening substantially equal to the particular thickness of the flange portions for receiving the flange portions in substantially aligned relationship with the sides of the frame member and the substantially straight-sided flange portions of the face member and thereby making the copy area of the face member substantially coextensive with the sides of the frame member.

2. The display sign of claim 1 additionally including a second face member having a copy area located in a plane substantially perpendicular to the common axis and substantially parallel to the plane of the copy area of the one face member, the second face member including substantially straight-sided flange portions provided at its ends with the particular thickness and angularly disposed to the copy area in a direction substantially parallel to the frame member and displaced from the frame member, and a retainer member disposed in substantially flush relationship with the frame member and coupling the frame member and the flange portions of the second face member and including an opening substantially equal to the particular thickness of the flange portions of the second face member for receiving the flange portions in substantially aligned relationship with the sides of the frame member and the substantially straight-sided flange portions of the second face member and thereby making the copy area of the second face member substantially coextensive with the sides of the frame member.

3. The display sign of claim 1 wherein the retainer member along one side is hinged to the frame member.

4. The display sign of claim 1 wherein the retainer member is formed from two interlocking T-shaped portions and the opening is formed between opposing legs of the two T-shaped portions and a gasket is disposed in the opening to seal the flange portion of the face member relative to the frame member.

5. The display sign of claim 1 wherein the retainer member is formed from a unitary member having a pair of leg portions forming the opening and a gasket is disposed in the opening to seal the flange portion of the face member relative to the frame member.

6. The display sign of claim 1 wherein the opening includes a sealing gasket to seal the substantially straight-sided flange portions within the opening even with changes in temperature.

7. A display sign, including:

a pair of opposing face members each having a copy area and having angular substantially straight-sided flange portions of a particular thickness, the flange portions extending in substantially perpendicular relationship to the copy area, a frame member having opposing edges disposed in spaced relationship to the flange portions of the face members in substantially the same plane as the flange portions, a pair of retainer members intercoupling the opposing edges of the frame member and the substantially straight-sided flange portions of the opposing face members, and each of the retainer members extending along one edge of the frame member and including an opening having a width substantially equal to the particular thickness of the flange portions for receiving the flange portions of the face members, each opening being substantially aligned with the frame member.

8. The display sign of claim 7 wherein at least one of the retainer members is hinged to the frame member along one side.

9. The display sign of claim 7 wherein the retainer members are formed from two interlocking T-shaped portions and each opening is defined by opposing legs of the two T-shaped portions.

10. The display sign of claim 7 wherein each of the retainer members is formed from a unitary member having a pair of leg portions disposed relative to each other to define the opening.

11. The display sign of claim 7 wherein each of the openings includes a sealing gasket to seal the substantially straight-sided flange portions within the opening.

12. A display sign, including, at least one face member having a copy area and having, at opposite ends of the copy area, flange portions extending in a direction substantially perpendicular to the copy area, a pair of frame members each extending from the flange portions in substantially the same direction as the flange portions on the face member and having a disposition substantially flush with the flange portions and having a displaced relationship to the flange portions of the face member, and a pair of retainer means each disposed between one of the flange portions on the face member and the associated one of the frame members and coupling the flange portion and the associated frame member and retaining the flange portion on the associated frame member in substantially flush relationship with the associated frame member.

13. The display sign of claim 12 wherein each of the retainer means includes means for cushioning and sealing the associated flange portions relative to the associated frame members even under considerable variations of temperature.

14. The display sign of claim 13 wherein each of the retainer means includes first means releasably attached to the face member for cushioning and sealing the associated flange portion relative to the first means even under considerable variations of temperature and second means releasably attached to the first means in a relationship to extend the cushioning and sealing of the associated flange to the frame member.

* * * * *